US006004424A

United States Patent [19]

Faust

[11] Patent Number: 6,004,424

[45] Date of Patent: Dec. 21, 1999

[54] METHODS OF SEALING BOXES WITH ADHESIVE TAPE UTILIZING MULTIPLE TAPE ROLLS

[75] Inventor: Michael C. Faust, White Bear Lake, Minn.

[73] Assignee: 3M Innovative Properties Company, St. Paul, Minn.

[21] Appl. No.: 08/291,176

[22] Filed: Aug. 16, 1994

[51] Int. Cl.[6] ..... B65B 7/20; B65B 51/06

[52] U.S. Cl. ..... 156/297; 53/377.2; 53/378.3; 156/264; 156/265

[58] Field of Search ..... 156/492, 485, 156/484, 483, 486, 489, 475, 212, 477.1, 468, 443, 302, 297, 303, 264, 265, 271; 53/136.4, 378.3, 377.2

[56] References Cited

U.S. PATENT DOCUMENTS

| | | | |
|---|---|---|---|
| 1,268,105 | 6/1918 | Ford | 156/264 X |
| 2,080,386 | 5/1937 | Fischer | 156/303 X |
| 2,086,988 | 7/1937 | Osgood | 12/51 |
| 2,250,774 | 7/1941 | Piller | 242/55.5 |
| 2,511,559 | 6/1950 | Banff et al. | 156/264 X |
| 2,687,978 | 8/1954 | Vogt | 154/53.6 |
| 2,747,664 | 5/1956 | Corson | 164/38 |
| 2,788,852 | 4/1957 | Sharpe | 164/39 |
| 2,822,286 | 2/1958 | Vogt | 117/4 |
| 2,830,003 | 4/1958 | Mason | 156/271 X |
| 2,895,272 | 7/1959 | Krukonis | 53/21 |
| 2,926,807 | 3/1960 | Park | 216/22 |
| 2,980,159 | 4/1961 | Greene | 156/554 |
| 3,176,555 | 4/1965 | Bowker et al. | 83/28 |
| 3,768,713 | 10/1973 | Lash | 225/34 |
| 3,936,944 | 2/1976 | Byne | 33/137 R |
| 3,950,203 | 4/1976 | Van der Wal | 156/213 |
| 4,560,433 | 12/1985 | Frank | 156/459 |
| 4,572,452 | 2/1986 | Driscoll et al. | 242/56.2 |
| 4,684,433 | 8/1987 | Gohr | 156/517 |
| 4,701,239 | 10/1987 | Craig | 156/519 |
| 4,732,644 | 3/1988 | Chiu | 156/468 |
| 5,037,501 | 8/1991 | Lawson | 156/527 |
| 5,228,943 | 7/1993 | Vasilakes | 156/468 |
| 5,354,410 | 10/1994 | Cohen et al. | 156/486 X |

FOREIGN PATENT DOCUMENTS

| | | | |
|---|---|---|---|
| 0 040 264 | 11/1981 | European Pat. Off. . | |
| 1384612 | 11/1964 | France | 156/468 |
| 2463060 | 3/1981 | France | 156/297 |
| 5-59334 | 3/1993 | Japan . | |

OTHER PUBLICATIONS

Technical Data Page for 3M Scotchfoam™ Single Coated Foam Tape, Nov., 1993, published by 3M Industrial Tape and Specialties Division.

Brochure entitled "NITOMATIC" from the Nitto Danko Corporation (in Japanese) ( no date).

3M Application Update #106, #107, #112, #158, and #254 for Scotchfoam™, published by 3M Industrial Specialties Division (no dates).

*Primary Examiner*—Richard Crispino
*Attorney, Agent, or Firm*—Michaele A. Hakamaki

[57] ABSTRACT

Methods of sealing boxes by applying multiple lengths of box sealing tape on box flaps are described. The box may be of the type where the outermost pair of flaps are shortened such that they do not meet each other when the flaps are folded toward each other and for boxes where the outermost pair of flaps do meet each other. A tape source is provided that includes a cylindrical core assembly that has an outer surface about which plural tape lengths are circumferentially wound. The cylindrical core assembly may either comprise a single core or may comprise multiple cores that are attached to each other in a manner so that the multiple cores function in use as a single core. The methods of sealing boxes in accordance with this invention are carried out with box sealing tape used on a box sealing machine.

17 Claims, 3 Drawing Sheets

METHODS OF SEALING BOXES WITH ADHESIVE TAPE UTILIZING MULTIPLE TAPE ROLLS

TECHNICAL FIELD

The present invention relates generally to various methods of sealing box flaps using adhesive tape. More specifically, the present invention relates to box sealing using plural tape lengths that are applied to the plural flaps of a box side.

BACKGROUND OF THE INVENTION

Manufacturers and suppliers of products often package their products in shipping containers before sending products to their customers. Each shipping container may accommodate either a single product or multiple products, depending on the application. Moreover, the container allows for ease in handling, shipping, and storing the products, along with providing protection from damage, theft, and contamination.

Although many types of shipping containers and container materials are readily available on the market, one of the most common shipping containers is a corrugated cardboard container or box. Boxes are typically both economical and sufficiently strong for most shipping uses and come in many shapes and sizes. However, included in the known type of boxes to which the present invention is applied are the regular slotted carton and the regular slotted carton with shortened flaps.

The first box type pertinent to the present invention is the regular slotted carton. As shown in FIG. 1, the regular slotted carton is generally rectangular and comprises four contiguous vertical side surfaces and two pair of flaps, commonly known as the major and minor pairs of flaps, on both the top and bottom of the box. Each of the flaps is connected to one of the vertical side surfaces, such that when the pairs of major and minor flaps are folded toward each other and toward the center of the box, the edges of at least the major flaps meet near the center of the top or bottom of the box, effectively creating the top and bottom horizontal surfaces of the box and closing the box.

The flaps on the regular slotted carton are typically sealed in place by glue or by pressure sensitive adhesive tape. The tape is often applied in either a "C-clip" or an "L-clip" configuration, both of which are commonly known in the art and are described below.

The C-clip is so named because a cross-section of the tape is in the shape of the letter "C". More specifically, a C-clip of tape.is a continuous length of adhesive tape that is applied to a portion of one vertical side of a box, across the center of one of the horizontal surfaces of the box to seal the abutting major flaps together, and finally to a portion of the opposite vertical side of the box. Moreover, the tape for a C-clip is typically wide enough to be applied along the abutting flaps such that both flaps of the outermost, or major, pairs of flaps on the top and bottom of the box are sealed by a single piece of tape. When the regular slotted carton is closed and sealed with a C-clip of adhesive tape, there are no substantial gaps to allow contaminants to reach the product or products enclosed in the box.

The L-clip is so named because a cross-section of the tape is in the shape of the capital letter "L". More specifically, an L-clip of adhesive tape comprises a length of adhesive tape that is applied to a portion of one vertical side of the box and to an adjacent portion of one of the horizontal surfaces of the box, effectively securing one or both of the abutting flaps of the horizontal surface to the vertical side of the box. The number of L-clips applied to a single box can vary based on the manufacturer's or supplier's requirements for the integrity of the box in its sealed condition.

One problem associated with a regular slotted carton sealed with C-clips or L-clips is that the person opening the box typically needs a sharp instrument to penetrate the tape and access the objects inside the box. A new alternative method of sealing these boxes that would allow the boxes to be opened quickly and easily would save the person opening the boxes considerable time and effort.

However, in many circumstances, the manufacturer or supplier uses a shipping box mainly to keep multiple products contained in a single shipping container; therefore, the primary purpose of the box is not to prevent damage, theft, or contamination of the products in the box. In these cases, the regular slotted carton may provide more protection than is necessary for the products. Moreover, because the price of a box is directly related to the quantity of raw materials (e.g., corrugated cardboard) used in manufacturing the box, the cost of using regular slotted cartons may be unnecessarily high for those box users who do not need as complete a protection for their products.

To address these concerns, container manufacturers produce a second type of box also considered pertinent to the present application; a regular slotted carton with shortened or "shied" pairs of major and minor flaps that do not meet each other when the box is closed. Instead, when the box is in its closed condition, there is a gap between both the major and minor pairs of flaps. Boxes of this type use substantially less raw materials, which correspondingly reduces both the costs to produce the boxes and ultimately reduces the amount of waste generated when disposing of the boxes. The reduced box production costs may then be passed on to the manufacturer or supplier who is purchasing the boxes; ultimately, these cost savings may then be passed on to the consumer of the products that are shipped in these boxes.

Boxes with shied flaps are commonly sealed with hot glue that is applied at each of the intersections of the major and minor flaps as the box is being closed. Although hot glue can be adequate to seal the box, hot glue dispensing equipment requires greater care in use and the glue nozzles are often subject to high maintenance costs.

An alternate method of sealing boxes with shied flaps is to apply two C-clips of box sealing tape to the major pair of flaps, with one C-clip applied on each flap of the pair. For example, it is known to apply two C-clips from two separate tape sources (i.e., rolls), each mounted on a separate taping head provided on a box sealing machine. One disadvantage of box sealing machines with plural taping heads is that the costs for the tape application equipment on these machines is higher than for machines with one supply source and taping head. Moreover, in the normal operation of a packaging machine with two supply sources, when one roll of tape is depleted or broken and needs replacement with a new roll, the operator will likely dispose of both the depleted roll and the other roll at the same time so that he or she will not have to shut down the machine again when the other roll is depleted. This procedure can often waste substantial quantities of tape.

The general application of single lengths of box sealing tape to boxes in either a C-clip, L-clip, or other configuration by various apparatuses such as hand-held devices and automatic and semi-automatic box sealing machines is well known. However, there is a continuing need in the packaging industry for improved methods of sealing boxes.

SUMMARY OF THE PRESENT INVENTION

The present invention provides for methods of sealing boxes by applying multiple lengths of box sealing tape in a similar manner to a box surface for closing the box and which addresses the shortcomings of the prior art in a variety of situations. These methods can be used for boxes where the outermost pair of flaps are shortened such that they do not meet each other when the flaps are folded toward each other and for boxes where the outermost pair of flaps do meet each other.

In one aspect of the present invention, a tape source is provided that includes a cylindrical core assembly that has an outer surface about which plural tape lengths are circumferentially wound. Plural lengths of pressure sensitive adhesive tape that are substantially similar in length are spaced axially along the width of the cylindrical core assembly and wound onto the outer surface of the cylindrical core assembly. The cylindrical core assembly may either comprise a single core or may comprise multiple cores that are attached to each other in a manner so that the multiple cores function in use as a single core.

In one version, the tape source includes two lengths of pressure sensitive adhesive tape wound onto a one-piece hollow cylindrical core. The width of the core is preferably at least as large as the summation of the widths of the two lengths of pressure sensitive adhesive tape. More preferably, two rolls of tape are located on the core so that the inside edges of the two rolls are in contact with each other and the outside edges of the two rolls are aligned with the outer edges of the core.

In another version, the tape source includes two tape rolls that are wound in axially adjacent positions onto a composite hollow cylindrical core assembly. Preferably, two rolls of tape are located on the core so that the inside edges of the two rolls are in contact with each other and the outside edges of the two rolls are aligned with the outer edges of the core.

The methods of sealing boxes in accordance with this invention are carried out with box sealing tape used on a box sealing machine. The box sealing machine preferably has a box guide path that comprises at least one taping head, conveying means for driving boxes along the machine, an application roller, and a buffing roller. In one method, a box is provided in its closed position to the box sealing machine within the box guide path. The tape source preferably comprises plural tape lengths wound on a common core assembly and supplies two lengths of adhesive tape to at least one taping head, which then provides the tape to the at least one application roller. When the conveyors initiate movement between the box and the taping head, the application roller applies, and the buffing roller buffs, the two lengths of tape to at least a portion of one vertical surface of the box and at least a portion of one of a pair of opposed flaps on another surface before the tape lengths are severed. The box may either be of the type where there is no significant gap between the opposed flaps or of the type where the flaps are intentionally shortened to provide a substantial gap between the flaps. If there is a gap between the pair of opposed flaps, the two lengths of tape may be spaced on opposite sides of the gap and/or may be spaced such that the distance between the two lengths of tape is at least as wide as the gap between the pair of opposed flaps. If there is no gap between the pair of opposed flaps, the two lengths of tape may be spaced such that one length of tape is applied to one of the opposed flaps and the other length of tape is applied to the other opposed flap, with or without a space between the two lengths of tape.

In another method, the plural lengths of tape, whether from a common source or independent sources, are applied to a box surface by way of the same taping head at the same time. In another method, the method includes the step of providing the tape source as a length of tape and includes splitting that tape length into plural tapes before application. Application could be provided by one or more taping heads.

DETAILED DESCRIPTION OF THE PREFERRED EMBODIMENT

Figure 2:
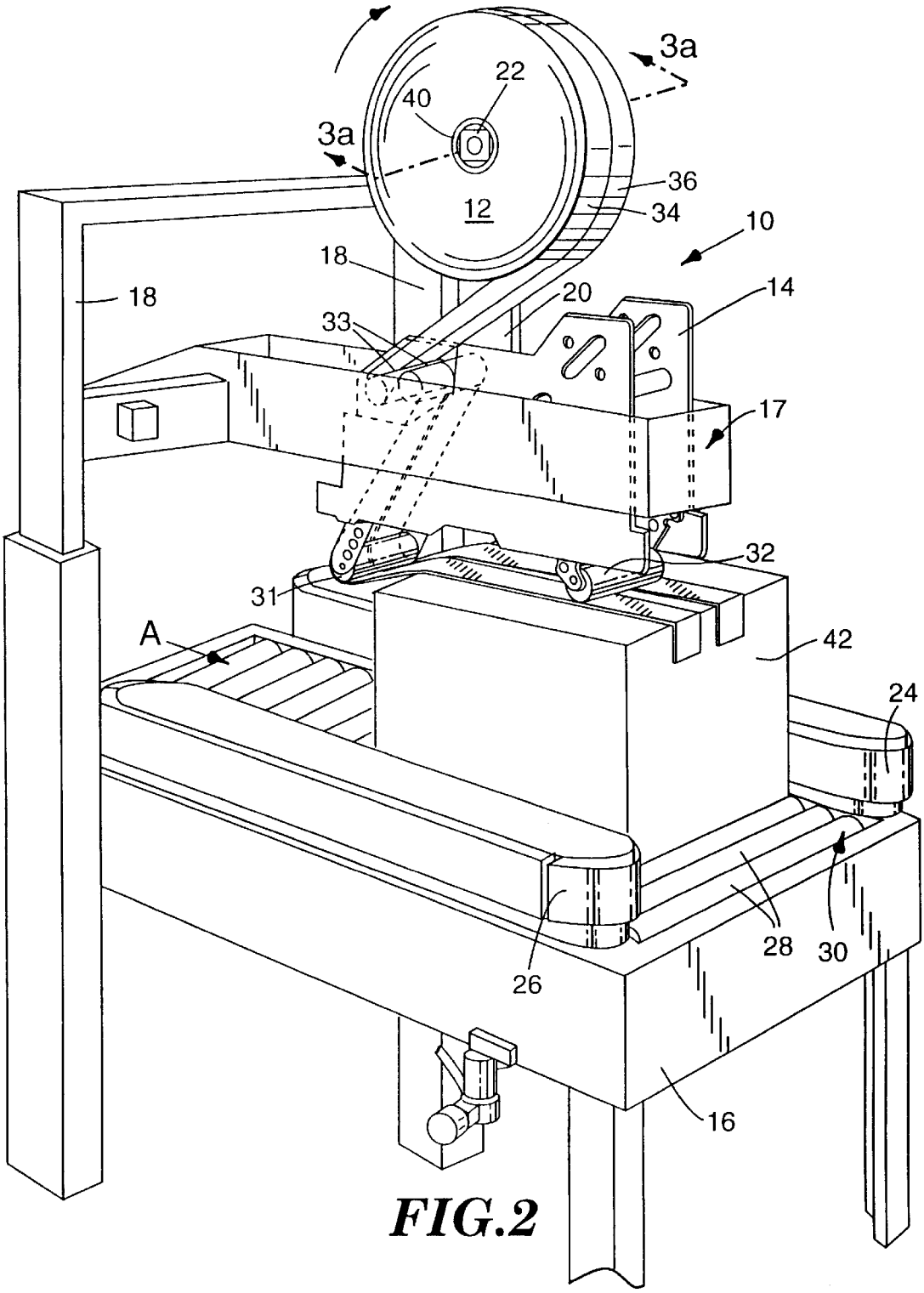
FIG. 2 is a partial perspective view of a representative box sealing machine in accordance with the present invention further showing a dual tape roll wound on a single core assembly.

Referring now to the Figures, wherein the components are labeled with like numerals throughout the several Figures, and initially to FIG. 2, a box sealing machine 10 for applying tape lengths to boxes is illustrated which basic components comprise a tape source 12 for supplying tape to be dispensed and a taping head 14 for applying tape lengths to boxes and which is supported relative to a base 16. The taping head 14, as shown, supports the tape source 12. Taping head 14 is preferably of the type available from Minnesota Mining and Manufacturing Company of St. Paul, Minn., as 3M™ Accuglide™ taping heads. One specific example is described in U.S. Pat. No. 5,228,943, entitled Low Impact Tape Applying Device, commonly owned by the assignee of the present invention, the complete disclosure of which is incorporated herein by reference. As used throughout this application, the term tape is preferably meant to include pressure sensitive adhesive box sealing tapes such as Scotch™ box sealing tapes, product numbers 372 and 373, commercially available from Minnesota Mining and Manufacturing Company or other similar adhesive tapes used in box sealing applications. However, other web materials, whether adhesive coated or not, that are applied in the manner of a box sealing machine 10 are also contemplated.

The box sealing machine 10 comprises the base 16 and an upper support 17 positioned relative to the base 16 by way of a strut mechanism 18. The upper support 17 is preferably vertically adjustably connected with the base 16 by the strut mechanism 18 which is conventionally vertically adjustable (not shown) to accommodate different height boxes. The upper support 17 supports the taping head 14 to which is preferably connected a tape support member 20. The tape support member 20 further supports the tape source 12, which is rotatably mounted by way of a hub 22, as conventionally known.

In accordance with the illustrated embodiment, a box guide path is defined along the base 16 by conveyors 24 and 26 which are adapted to move an object over the rollers 28 comprising bed 30 and past the taping head 14 and, more specifically, to contact an application roller 31 and a buffing roller 32 of the taping head 14. The operation of such conveying mechanisms are well understood in the art and it is contemplated that other conveying means, whether automatic or manual, could be utilized as presently known or developed.

Also provided are means for defining a tape path, which includes guide rolls 33 mounted within the taping head 14 for guiding the tape from the tape source 12 through the taping head 14 and to the application roller 31. The manner of connection and operation of the application roller 31 and buffing roller 32 for applying tape is well known and fully described in the aforementioned U.S. Pat. No. 5,228,943. The taping head 14 preferably includes the guide rollers 33 which, with the application roller 31, define the tape path and which also assist in tension control of the tape. In the illustrated embodiment, the taping head 14 is positioned directly above the box guide path for sealing the top of a box; however, another taping head 14 is typically provided in the bed 30, as conventionally mounted, to provide tape to the bottom of a box as well. In addition, other various configurations and locations of taping heads and rollers are contemplated by the present invention, such as multiple taping heads located above the box guide path, below the box guide path, or both above and below the box guide path. Side box sealing devices are also contemplated.

The box sealing machine 10 is typically used for rectangular boxes or cartons of the type comprising a front vertical surface, a rear vertical surface, two vertical side surfaces, and two pair of opposed flaps on both the top and bottom of the box. In order to close the top of the box, for example, a first pair of flaps, hereinafter the minor pair of flaps, are typically folded toward each other. Next, a second pair of flaps, hereinafter the major pair of flaps, are folded toward each other. In the preferred embodiment, the major pair of flaps effectively comprise the top and bottom horizontal surfaces of the box. Although the typical box is described above, other box configurations are contemplated to be used in connection with the present invention, such as boxes with more or less than four sides and boxes with only one pair of flaps on the top and bottom of the box and the like.

Figure 1:
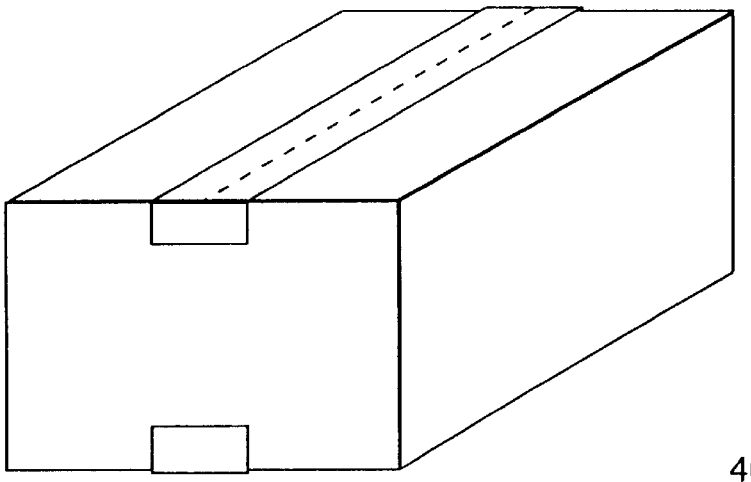
FIG.1 (PRIOR ART)
FIG. 1 is a perspective view of a prior art regular slotted carton sealed with C-clips of tape on the top and bottom of the box.

Boxes are commonly referred to as regular slotted cartons when the nearest edges of the major pair of flaps are, or nearly are, in contact with each other when the box is closed. The regular slotted carton, as shown in FIG. 1 of the Prior Art, is typically designed and manufactured so there are essentially no spaces between the nearest edges of the pair of flaps when the box is closed. However, due to manufacturing tolerance errors or box overstuffing, when the box is in its closed configuration, a slight gap may be formed between the flaps along the length of the edges or the flaps can slightly overlap each other.

The box sealing machine 10 of the present invention can also be used for application of tape to boxes with intentionally shortened or "shied" flaps. This type of box is designed and manufactured with flaps that are shorter than those of the regular slotted carton, such that when the flaps are folded toward each other, there is a substantial gap intentionally provided between the nearest edges of each of the major and minor pairs of opposed flaps. Alternatively, it may be said that the pairs of flaps are "shy" of contacting each other when the box is in a closed position. The flaps are therefore considered "shortened" or "shied" as compared to the flaps of the regular slotted carton. The present invention is particularly adapted for use with both regular slotted cartons or regular slotted cartons with shortened flaps, along with boxes that use a combination of pairs of flaps that are shortened with pairs of flaps that are not shortened.

Figure 3A:
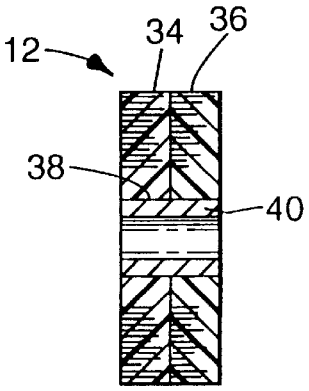
FIG. 3*a* is a cross-sectional view taken along line 3*a*—3*a* of FIG. 2 of a dual tape roll comprising plural rolls of tape and a single core piece.
Figure 3B:
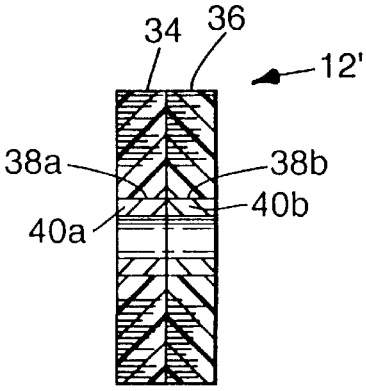
FIG. 3*b* is a cross-sectional view taken along line 3*a*–3*a* of FIG. 2 of an alternative dual tape roll comprising plural rolls of tape on a single core assembly made up of multiple adjacent core pieces.

FIGS. 2, 3*a*, and 3*b* illustrate the preferred embodiments of the tape source 12 where, in accordance with one aspect of the present invention, the tape source 12 comprises two adjacent lengths of box sealing tape 34 and 36 circumferentially wound onto the outside surface 38 of a cylindrical core assembly 40. Each of these lengths of tape 34 and 36 are preferably the same, although there may be a difference between the length and/or width of tape 34 and the length and/or width of tape 36. The method of making such a tape roll is described below. Box sealing tapes, specifically including Scotch™ box sealing tapes, product numbers 372 and 373, comprise a backing layer film with a layer of adhesive coated to one side of the backing layer. A non-exclusive list of conventional polymeric backing layer films follows with the understanding that any could be suitable for use as a tape backing layer: polyethylene, polypropylene, polyester (such as polyethylene terepthalate (PET)), biaxially oriented polypropylene (BOPP), polyvinyl chloride (PVC), copolymers of propylene and ethylene, and copolymers of ethylene and olefins having four or more carbon atoms.

Further, suitable adhesives for use in the box sealing tape of the present invention are generally based on general compositions of polyacrylate; polyvinyl ether; diene-containing rubber such as natural rubber, polyisoprene, and polybutadiene; styrene-butadiene rubber; polychloroprene; butyl rubber; butadiene-acrylonitrile polymer; thermoplastic elastomer block copolymers such as styrene-isoprene (SI) and styrene-isoprene-styrene (SIS) block copolymers, styrene-butadiene (SB) and styrene-butadiene-styrene polymers (SBS), and ethylene/propylene and ethylene-butylene-diene polymers such as styrene-ethylene/propylene-styrene (SEPS) and styrene-ethylene/butylene-styrene (SEBS); poly-alpha-olefin; amorphous polyolefin; silicone; ethylene-containing copolymer such as ethylene vinyl acetate, ethyl ethyl acrylate, and ethyl methacrylate; polyurethane; polyamide; epoxy; polyvinylpyrrolidone and vinylpyrrolidone copolymers; polyesters; and mixtures of the above. The use of many of these compositions to give specific characteristics to the adhesives may require cross-linking or curing by methods well known in the art. Additionally, the adhesives can contain additives such as tackifiers, plasticizers, stabilizers, curatives, and solvents.

In addition, a low adhesion backsize is preferably provided on the other side of the backing layer so that the tape separates more easily when unwound from a tape roll. Such coatings and/or treatments are well known, and any can be used in accordance with the present invention if they are otherwise suitable for use in the desired tape construction.

Referring now to FIG. 3*a*, the cross-sectional view of the tape source 12 is illustrated in its preferred embodiment, with a cylindrical core assembly 40 comprising a single core piece with adjacent lengths of tape 34 and 36 wound onto the outside surface 38 of the single core piece. More specifically, the cylindrical core assembly 40 is preferably constructed of cardboard or plastic tubing, although any known or developed core material may be utilized by the present invention.

FIG. 3*b* illustrates an alternative embodiment of the tape source 12', where the cylindrical core assembly 40 comprises two core pieces 40*a* and 40*b*. Each of these core pieces 40*a* and 40*b* preferably has one of the lengths of tape 34 and 36 wound onto its outside surface 38*a* or 38*b*, respectively. These two core pieces 40*a* and 40*b* together make up a single core assembly in that they are to be rotationally held together in axially adjacent locations. To rotationally lock the core pieces together, they may be fixed directly with one another by means such as glue, fasteners, or the like, or they may be functionally fixed by indirect means such as provided by external forces that may be generated when mounted, such as clamps or chucks on either side of the core pieces. Alternatively, the core pieces can be indirectly locked together by way of the tape lengths 34 and 36 in roll form. The manufacturing process of making tape rolls often causes adhesive to migrate toward the outer edges of the tape making up the rolls, and axially adjacent tape rolls may adhere to each other without any additional means of fixing them together. In any case, when mounted on the tape support member 20, the core pieces 40*a* and 40*b* act as one core assembly. Although not specifically illustrated in the Figures, it is also contemplated that there can be space between the wound lengths of tape 34 and 36 when mounted on the cylindrical core assembly 40 or that there may be more than two lengths of tape mounted on the cylindrical core assembly 40 depending on the circumstances of the particular application.

The application of tape to boxes by the box sealing machine 10 in accordance with the present invention will now be described with reference to FIG. 2. Initially, the tape source 12, comprising the lengths of tape 34 and 36, is rotatably mounted to the hub 22 of the tape support member 20, as shown in FIG. 2. In accordance with certain of the methods of the present invention, the tape source 12 may be comprised as set forth above, having multiple tape lengths mounted on a single core assembly, or may be provided as plural rolls independently rotating and/or mounted relative to the taping head or taping heads.

In the FIG. 2 embodiment, the lengths of tape 34 and 36 are threaded through the same taping head 14 along the tape path to the application roller 31, in a manner to present the tape to apply to a box. Preferably, the tape path includes separate guide paths (not shown) through the taping head 14 (when a single taping head is used) so that the lengths of tape 34 and 36 are presented to the application roller 31 spaced from one another as they are to be applied to the box flaps. For example, the application roller 31 may either comprise a single roller as illustrated, or may comprise multiple rollers provided side by side on one or more axles. Further, the lengths of tape 34 and 36 may be spaced from one another within the taping head 14 by providing entirely separate guide systems or a single system including any known separating and guiding means, such as rollers with side edge extensions that guide the lengths of tape 34 and 36 along their desired tape paths.

In the illustrated embodiment, a box 42, which is a regular slotted carton, is supplied to the box sealing machine 10 in the direction of arrow A, in a closed condition. The taping head 14 guides the lengths of tape 34 and 36 from tape source 12 to the application roller 31, which then presents the adhesive sides of the lengths of tape 34 and 36 toward the front vertical surface of the box 42. Although it is preferable that the tape source 12 comprise a single tape core supplying multiple lengths of tape to a single taping head as described above, the tape source 12 may alternatively comprise two tape cores that are allowed to rotate relative to one another.

As the conveyors 24 and 26 move the box 42 over the bed 30 along the box guide path, the front vertical surface of the box 42 contacts the lengths of tape 34 and 36 positioned on the application roller 31. The application roller 31 then presses the leading edges of the lengths of tape 34 and 36 against the box 42 with the force necessary to adhere both lengths of tape to the box 42. While the box 42 continues to move along the box guide path, the tape continues to be pulled by the taping head 14 from the tape source 12 and the application roller 31 is driven upward by the box 42 along its support guide path within the taping head 14 and vertically along the front vertical surface of the box 42 toward the top horizontal surface of the box. Further, after the application roller 31 applies the lengths of tape 34 and 36, the buffing roller 32, which is preferably pivotally connected to the taping head 14 and interconnected by a link mechanism (not shown) to the application roller support as conventionally known, rolls over the newly applied lengths of tape 34 and 36 to smooth the tape onto the surface of the box 42. The lengths of tape 34 and 36 are typically applied to only a portion of the front vertical surface of the box 42.

After the lengths of tape 34 and 36 are applied to at least a portion of the front vertical surface of the box 42 and the application roller 31 has moved to the corner of the front vertical surface and the top horizontal surface of the box 42, the lengths of tape 34 and 36 are then applied to the top horizontal surface of the box 42 by way of the application roller 31 and smoothed by the buffing roller 32. After the lengths of tape 34 and 36 have been applied to at least a portion of the top horizontal surface of the box 42, a conventional cutting means (not shown) may sever the tape. If the lengths of tape 34 and 36 are severed before the tape is applied to the entire length of the top horizontal surface of the box 42, it is commonly said that an "L-clip" of tape has been applied to the box, since the cross-sectional shape of the tape section resembles the capital letter "L".

Alternatively, the lengths of tape 34 and 36 may not be severed during application to the top horizontal surface of the box 42. Rather, the application roller 31 may apply two continuous lengths of tape 34 and 36 to at least a portion of the front vertical surface, across the entire top horizontal surface and to at least a portion of the rear vertical surface of the box 42 before the tape is severed by the cutting means. When lengths of tape are applied in this manner, it is commonly said that a "C-clip" of tape has been applied to the box, since the cross-sectional shape of the tape section resembles the letter "C".

Although the above description refers specifically to sequentially applying tape to the front vertical surface, the top horizontal surface, and the rear vertical surface of the box 42, it is understood that this description can also be useful for operations where tape is applied to other vertical surfaces of the box 42, to the bottom horizontal surface of the box 42, and/or where the tape is applied in a different sequence than that described above. In addition, it is contemplated that the box sealing machine 10 may apply either L-clips, C-clips, or a combination of L-clips and C-clips of tape to the box 42. It is further contemplated that multiple taping operations may be occurring simultaneously on the same box 42.

One alternative to the illustrated embodiment is a box sealing machine 10 similar to that shown in FIG. 2 where the taping head 14 instead comprises two separate taping heads, such that each taping head is used for one of the lengths of tape 34 and 36. Application of the lengths of tape 34 and 36 to the box 42 with two separate taping heads would otherwise be similar to that of the box sealing machine with a single taping head described above. Further, when a box sealing machine 10 has two separate taping heads, the tape source 12 of the type comprising two lengths of tape 34 and 36 provided on a common core assembly may be mounted to one taping head such that one length of tape can be fed to the taping head on which it is mounted and the other length of tape can be fed to the other taping head. Alternatively, the common tape source 12 comprising two lengths of tape 34 and 36 may be mounted on the box sealing machine 10 in a location independent from both of the taping heads such that the two lengths of tape can be fed to the two separate taping heads. In addition, it is contemplated that if the tape source 12 comprises more than two lengths of tape mounted on a single cylindrical core assembly 40, as previously discussed, the box sealing machine 10 could have a corresponding number of taping heads and the tape source 12 could then be mounted on any one of the taping heads or mounted on the box sealing machine 10 independently from all the taping heads.

A second alternative embodiment is a box sealing machine 10 with a tape source 12 comprising a relatively wider single length of tape and a slitting means (not shown) located along the tape path between the tape source 12 and the taping head 14 so that the slitting means can divide the single length of tape into two lengths of tape 34 and 36. For example, a blade could be mounted to either cut the tape after it is unwound from the tape source 12 or while on the roll during its rotation but before being unwound from the tape source 12. The lengths of tape 34 and 36 would then be applied to the box 42 in the same manner described above. This alternative embodiment of the box sealing machine 10 may use either one or two taping heads.

Figure 4:
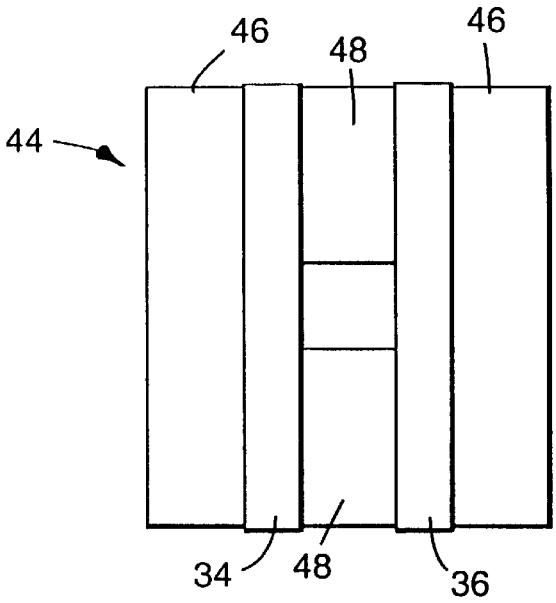
FIG. 4 is a top view of a box with shied flaps sealed with box sealing tape in accordance with the present invention.

FIG. 4 illustrates a preferred spacing of C-clips of the lengths of tape 34 and 36 as applied to a closed box 44 with shied flaps, where the box 44 comprises a pair of major flaps 46 and a pair of minor flaps 48 with a gap between the nearest edges of each of the pairs of flaps 46 and 48. The length of tape 34 is adhered to one of the flaps of the pair of major flaps 46 and the length of tape 36 is adhered to the other of the flaps of the pair of major flaps 46 such that the nearest edges of the lengths of tape 34 and 36 correspond with, or nearly correspond with, the nearest edges of the pair of major flaps 46. Therefore, the gap between the nearest edges of the pair of major flaps 46 is equal to the gap between the lengths of tape 34 and 36.

Alternatively, the lengths of tape 34 and 36 may be applied with a gap between their nearest edges that is either larger or smaller than the gap between nearest edges of the major pair of flaps 46. If the gap between the nearest edges of the lengths of tape 34 and 36 is smaller than the gap between the nearest edges of the major pair of flaps 46, a portion of the lengths of tape 34 and 36 may be adhered both to the pair of major flaps 46 and to the exposed portion of the pair of minor flaps 48. However, if the gap between the nearest edges of the lengths of tape 34 and 36 is larger than the gap between the nearest edges of the major pair of flaps 46, there will be space between the nearest edge of each of the major flaps and the nearest edge of the length of tape adhered to that flap. These variations on placement and spacing of the tape are based on the condition that the lengths of tape 34 and 36 are equally spaced on either side of the centerline of the box. However, it is also contemplated that the lengths of tape 34 and 36 can be applied offset such that the length of tape 34 is a different distance from the centerline than is the length of tape 36.

The above discussion regarding the spacing of strips of tape on a closed box with shied flaps is also contemplated for spacing strips of tape on closed regular slotted cartons. The strips of tape on a regular slotted carton will be applied similarly to the pair of major flaps; preferably equally spaced on either side of the centerline of the box, but may also be offset from the center of the box. Further, the application of one of the two lengths of tape 34 and 36 on each of the major flaps of a regular slotted carton provides a means for opening the box that does not require the use of a sharp instrument; the flaps can be grasped at their nearest edges and pulled apart, thereby either breaking the tape or tearing the flaps.

Figure 5:
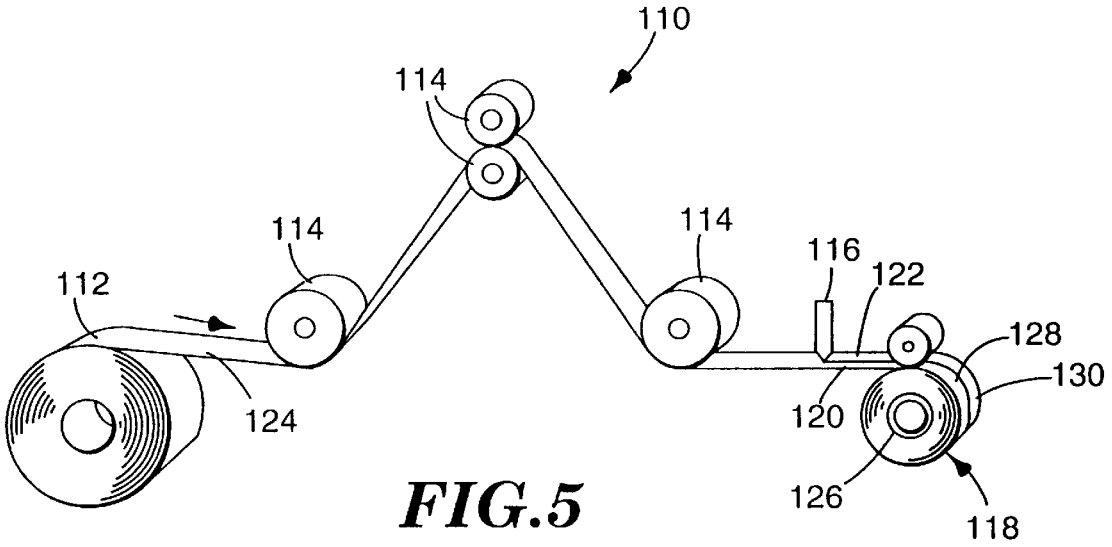
FIG. 5 is a schematic view in perspective of a representative web path for the method of making a dual tape roll.

With reference to the schematic drawing of FIG. 5, one method of making a tape roll with two adjacent lengths of tape on a single core assembly will now be described. FIG. 5 shows a slitting operation 110 comprising a supply roll of pressure sensitive adhesive tape 112 rotatably mounted in a roll unwind station (not shown), guiding and steering rollers 114, a slitting mechanism 116, and a dual tape roll 118 rotatably mounted in a roll rewind station (not shown). The supply roll of pressure sensitive adhesive tape 112 is at least as wide as the summation of the widths of two lengths of tape 120 and 122 that will result from the slitting operation.

Typically, one length of tape 124 is unwound from the supply roll of pressure sensitive adhesive tape 112, which is mounted in a conventional manner to rotate within the roll unwind station. One end of the length of tape 124 is threaded through the guiding and steering rollers 114 and is guided toward the slitting mechanism 116 as the length of tape 124 is being unwound from the supply roll of pressure sensitive adhesive tape 112. The length of tape 124 is then divided in the longitudinal direction by the slitting mechanism 116 to form the two lengths of tape 120 and 122. One end of each of the two lengths of tape 120 and 122 is then attached by conventional means in axially adjacent locations to the outer surface of a core assembly 126, which is mounted such that it can rotate within the roll rewind station.

The core assembly 126 is rotated within the roll rewind station in a direction such that the two lengths of tape 120 and 122 are circumferentially wound about the core assembly 126, effectively resulting in two tape rolls 128 and 130 mounted on a single core assembly 126. When the desired lengths of tape 120 and 122 are wound into the tape rolls 128 and 130, respectively, the lengths of tape 120 and 122 are severed in the transverse direction by conventional cutting means (not shown). The dual tape roll 118 is thereby comprised of the two tape rolls 128 and 130 and the core assembly 126. Although the method of making a dual tape roll has been specifically explained, it is to be understood that a similar method could be used for making a tape roll with more than two rolls of tape mounted on a single core assembly, with a duplication of means corresponding to the additional number of rolls. If the lengths of tape 120 and 122 are to be spaced from one another on the core assembly 126, appropriate guide rollers would be provided between the slitting mechanism 116 and the roll rewind station.

What is claimed is:

1. A method for sealing a plurality of boxes in sequence by applying discrete pieces of box sealing tape which are provided from plural lengths of box sealing tape of greater length than the applied discrete pieces of box sealing tape by a box sealing machine having a box guide path and at least one taping head that is positioned along the box guide path for applying the discrete pieces of box sealing tape to the boxes, the boxes of the type comprising a first surface, a second surface spaced from the first surface, and a pair of opposed flaps that when folded toward each other in a closed position provide a box surface between the first and second surfaces, comprising the steps of:

(a) supplying a first box with its opposed flaps in the closed position to the box sealing machine within the box guide path;

(b) providing box sealing tape to the at least one taping head from a tape source having a first length of box sealing tape and a second length of box sealing tape provided on a common cylindrical core assembly, wherein the first length of box sealing tape is rotationally fixed on the common cylindrical core assembly with respect to the second length of box sealing tape;

(c) initiating relative movement between the first box and the at least one taping head along the box guide path;

(d) during the relative movement, applying first and second discrete pieces of box sealing tape from the first and second lengths of box sealing tape of the tape source, respectively, to at least a portion of one of the first and second surfaces and at least a portion of one of the pair of opposed flaps of the first box; and (e) repeating steps (a) through (d) on a second box after a rest period.

2. The method of claim 1, wherein said application of box sealing tape comprises applying the first and second discrete pieces of box sealing tape to the first box along a portion of the first and second surfaces and to the flaps extending therebetween.

3. The method of claim 1, wherein said application of box sealing tape comprises applying the first and second discrete pieces of box sealing tape to the first box along a portion of the first and second surfaces and to only a portion of the flaps extending therebetween.

4. The method of claim 1, wherein the at least one taping head comprises a single taping head.

5. The method of claim 1, wherein the at least one taping head comprises plural taping heads.

6. The method of claim 1, wherein the first box comprises a pair of opposed flaps that are shortened to provide a substantial gap between the nearest edges when folded toward each other in a closed position and wherein said application of box sealing tape comprises applying the first discrete piece of box sealing tape on the opposite side of the gap from the second discrete piece of box sealing tape.

7. The method of claim 6, wherein said application of box sealing tape comprises applying the first and second discrete pieces of tape spaced from one another at a distance at least as wide as the gap between the flaps.

8. A method for sealing a plurality of boxes in sequence by applying discrete pieces of box sealing tape which are provided from plural lengths of box sealing tape of greater length than the applied discrete pieces of box sealing tape by a box sealing machine having a box guide path and a taping head that is positioned along the box guide path for applying the discrete pieces of box sealing tape to the boxes, the boxes of the type comprising a first surface, a second surface spaced from the first surface, and a pair of opposed flaps that when folded toward each other in a closed position provide a box surface between the first and second surfaces, comprising the steps of:

(a) supplying a first box with its opposed flaps in the closed position to the box sealing machine within the box guide path;

(b) providing box sealing tape to the taping head from a tape source including a first length of box sealing tape and a second length of box sealing tape;

(c) initiating relative movement between the box and the taping head along the box guide path;

(d) during the relative movement, applying first and second discrete pieces of box sealing tape by the same taping head from the first and second lengths of box sealing tape of the tape source, respectively, to at least a portion of one of the first and second surfaces and at least a portion of one of the pair of opposed flaps of the first box; and (e) repeating steps (a) through (d) on a second box after a rest period.

9. The method of claim 8, wherein said application of box sealing tape comprises applying the first and second discrete pieces of box sealing tape to the first box along a portion of the first and second surfaces and to the flaps extending therebetween.

10. The method of claim 8, wherein said application of box sealing tape comprises applying the first and second discrete pieces of box sealing tape to the first box along a portion of the first and second surfaces and to only a portion of the flaps extending therebetween.

11. The method of claim 8, wherein said application of box sealing tape comprises applying the first discrete piece of tape on one flap of the pair of opposed flaps and the second discrete piece of tape on the other.

12. The method of claim 11, wherein the box comprises a pair of opposed flaps that are shortened to provide a substantial gap between the nearest edges when folded toward each other in a closed position.

13. The method of claim 12, wherein said application of box sealing tape comprises applying the first and second discrete pieces of box sealing tape spaced from one another at a distance at least as wide as the gap between the flaps.

14. The method of claim 8, wherein the first length of box sealing tape and the second length of box sealing tape of said tape source are provided on a common cylindrical core assembly.

15. The method of claim 8, wherein the first length of box sealing tape and the second length of box sealing tape of said tape source are provided on separate cylindrical core assemblies.

16. A method for sealing a plurality of boxes in sequence by applying discrete pieces of box sealing tape which are provided from plural lengths of box sealing tape of greater length than the applied discrete pieces of box sealing tape by a box sealing machine having a box guide path and a single taping head that is positioned along the box guide path for applying the discrete pieces of box sealing tape to the boxes, the boxes of the type comprising a first surface, a second surface spaced from the first surface, and a pair of opposed flaps that when folded toward each other in a closed position provide a box surface between the first and second surfaces, comprising the steps of:

(a) supplying a first box with its opposed flaps in the closed position to the box sealing machine within the box guide path;

(b) providing box sealing tape to the taping head from a tape source having a first length of box sealing tape and a second length of box sealing tape provided on a common cylindrical core assembly, wherein the first length of box sealing tape is rotationally fixed on the common cylindrical core assembly with respect to the second length of box sealing tape;

(c) initiating relative movement between the first box and the taping head along the box guide path;

(d) during the relative movement, applying first and second discrete pieces of box sealing tape from the first and second lengths of box sealing tape of the tape source, respectively, to at least a portion of one of the first and second surfaces and at least a portion of one of the pair of opposed flaps of the first box; and (e) repeating steps (a) through (d) on a second box after a rest period.

17. A method for sealing a plurality of boxes in sequence by applying discrete pieces of box sealing tape which are provided from plural lengths of box sealing tape of greater length than the applied discrete pieces of box sealing tape by a box sealing machine having a box guide path and a taping head that is positioned along the box guide path for applying the discrete pieces of box sealing tape to the boxes, the boxes of the type comprising a first surface, a second surface spaced from the first surface, and a pair of opposed flaps that when folded toward each other in a closed position provide a box surface between the first and second surfaces, comprising the steps of:

(a) supplying a first box with its opposed flaps in the closed position to the box sealing machine within the box guide path;

(b) providing box sealing tape to the taping head from a tape source including a first length of box sealing tape and a second length of box sealing tape provided on a common cylindrical core assembly;

(c) initiating relative movement between the box and the taping head along the box guide path;

(d) during the relative movement, applying first and second discrete pieces of box sealing tape by the same taping head from the first and second lengths of box sealing tape of the tape source, respectively, to at least a portion of one of the first and second surfaces and at least a portion of one of the pair of opposed flaps of the first box; and (e) repeating steps (a) through (d) on a second box after a rest period.

* * * * *